United States Patent [19]

Rumsey

[11] 4,204,517

[45] May 27, 1980

[54] FIREPLACE FURNACE

[76] Inventor: Joseph N. Rumsey, Rte. 3, Box 327, Wilmington, N.C. 28401

[21] Appl. No.: 891,729

[22] Filed: Mar. 30, 1978

[51] Int. Cl.[2] ..... F24C 1/14

[52] U.S. Cl. ..... 126/63; 126/66; 126/121; 126/72; 126/83

[58] Field of Search ..... 126/121, 61, 63, 66, 126/67, 69, 70, 6, 72, 83

[56] References Cited

U.S. PATENT DOCUMENTS

| | | | |
|---|---|---|---|
| 4,092,976 | 6/1978 | Buckner | 126/63 |
| 4,111,182 | 9/1978 | Roberts et al. | 126/66 X |
| 4,127,100 | 11/1978 | Baker | 126/61 X |
| 4,150,658 | 4/1979 | Woods | 126/121 |

FOREIGN PATENT DOCUMENTS

| | | | |
|---|---|---|---|
| 249608 | 2/1964 | Australia | 126/121 |

*Primary Examiner*—Carroll B. Dority, Jr.
*Assistant Examiner*—Lee E. Barrett
*Attorney, Agent, or Firm*—Clarence A. O'Brien; Harvey B. Jacobson

[57] ABSTRACT

A firebox including front, rear and opposite sides interconnected by means of a bottom side at their lower ends and by a top side at their upper ends is provided. Outer rear and bottom walls extend between the rear marginal portions of the opposite sides rearwardly of the rear side and between the lower marginal portions of the opposite sides and the lower marginal edges of the rear wall and the front side below the bottom, respectively, defining a rear to front extending flow passage between the bottom side and wall and a downwardly extending flow passage between the rear side and rear wall. The interior of the firebox includes hollow upper opposite side front to rear extending side manifolds and an upper front transverse manifold extending between and communicated with the forward ends of the side manifolds. The top side has a flue outlet therein and a plurality of front to rear extending tubular heating air flow tubes extend between and communicate with the front transverse manifold at their front ends and rear upper portion of the downwardly extending flow passage at their rear ends. A blower is provided to pump air under pressure into the rear ends of the side manifolds and the front to rear extending passage opens through the lower marginal portion of the front side.

14 Claims, 4 Drawing Figures

FIREPLACE FURNACE

BACKGROUND OF THE INVENTION

Various forms of room heaters to be utilized in conjunction with a fireplace flue or to be provided with flue pipes independent of fireplace flues have been heretofore provided for use as space heaters and many are designed to burn various forms of solid fuel, such as wood and/or coal. However, many of these space or room heaters rely upon convection air and radiation to provide heat transfer from the heater to the interior of the room to be heated and are thus not as efficient as they might be if they were provided with structure operative to effect forced air circulation through the heater. In addition, many of these previously known room or space heaters experience a considerable waste of heat due to the unrestricted passage of flue gases upwardly from the fireboxes of the heaters outwardly through the flue pipes thereof. Accordingly, a need exists for a room or space heater utilizing forced ambient air for circulation through the heater and including structure whereby the maximum amount of heat may be extracted from the flue gases of the heater before they are ducted away from the latter through the flue pipe thereof.

Various forms of room and space heaters including some of the general structural and operational features of the instant invention are disclosed in U.S. Pat. Nos. 3,085,564, 3,880,141, 3,981,292, 3,995,611, 4,008,704, 4,015,581, 4,026,264 and 4,050,441.

BRIEF DESCRIPTION OF THE INVENTION

The fireplace furnace (room or space heater) is provided with a blower whereby air to be heated within a room in which the heater is disposed may be forced through a plurality of heat transfer passages within the confines of the exterior of the heater. Further, the fireplace burner includes initial air inlet passages for forced heating air disposed within the upper portion of the firebox of the heater and including spaced portions thereof extending transversely through the path of flue gases from the firebox outwardly through the flue pipe of the heater.

Also, the outlet for the forced heating air passages opens outwardly through a lower marginal forward portion of the heater and a supplemental forced air outlet opening opens downwardly from a bottom wall portion of the heater and may be coupled to heat pipes for conducting heated air to remote locations.

The main object of this invention is to provide a fireplace furnace (room or space heater) which may be operated at high efficiency to obtain the maximum amount of useful heat from a given amount of fuel burned within the firebox of the heater.

Another object of this invention is to provide a fireplace furnace which may be utilized in conjunction with a conventional fireplace flue, or which may utilize a separate flue pipe therefor.

Another important object of this invention is to provide a fireplace furnace constructed in a manner whereby the leakage of combustion gases into the forced heating air passages of the furnace will be substantially eliminated.

Yet another object of this invention is to provide a fireplace heater constructed in a manner whereby the top side thereof may be utilized for cooking purposes, if desired.

A final object of this invention to be specifically enumerated herein is to provide a fireplace furnace in accordance with the preceding objects and which will conform to conventional forms of manufacture, be of simple construction and dependable in operation so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
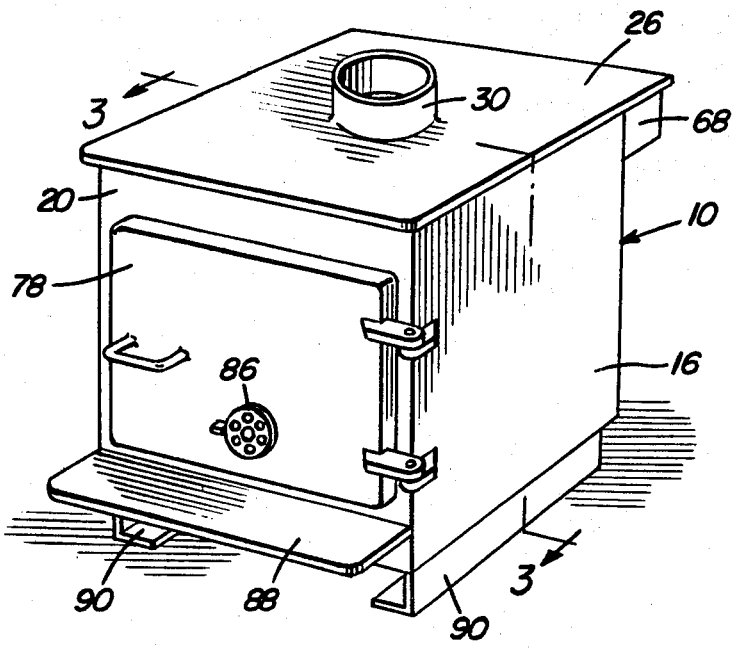
FIG. 1 is a perspective view of the fireplace furnace.
Figure 2:
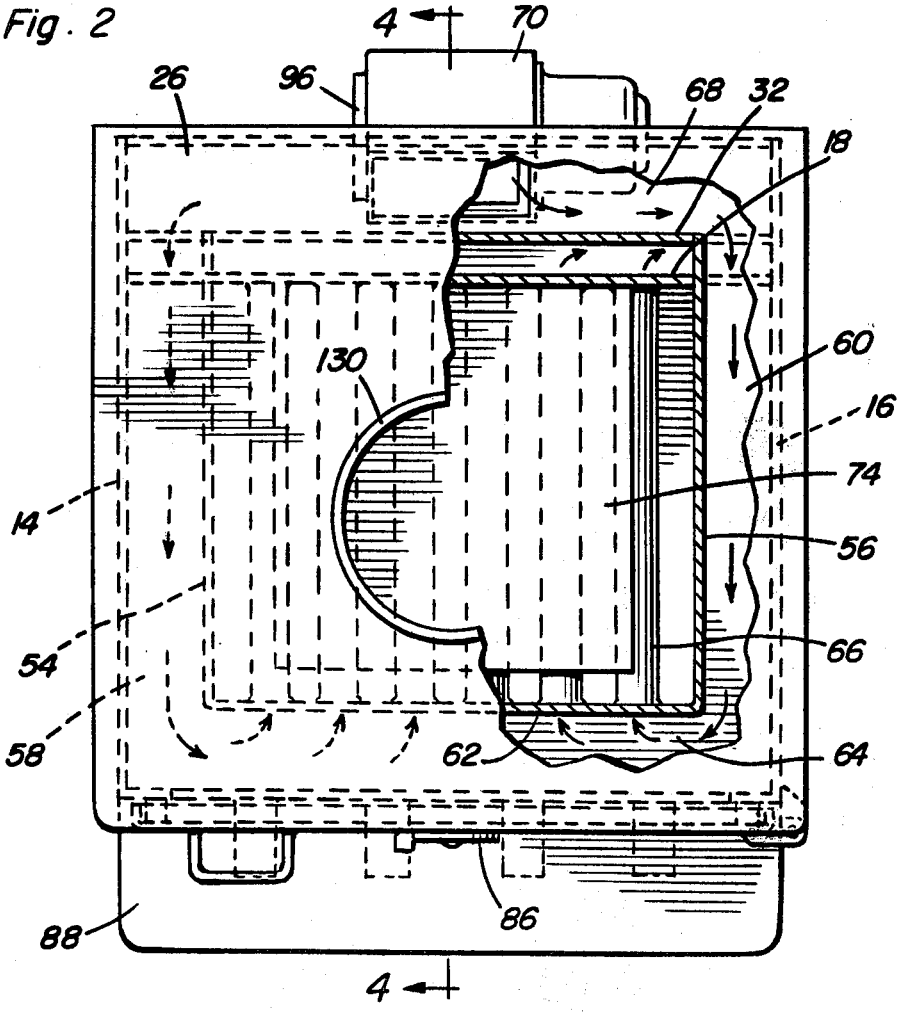
FIG. 2 is an enlarged top plan view of the fireplace furnace with portions thereof being broken away and illustrated in horizontal section.
Figure 4:
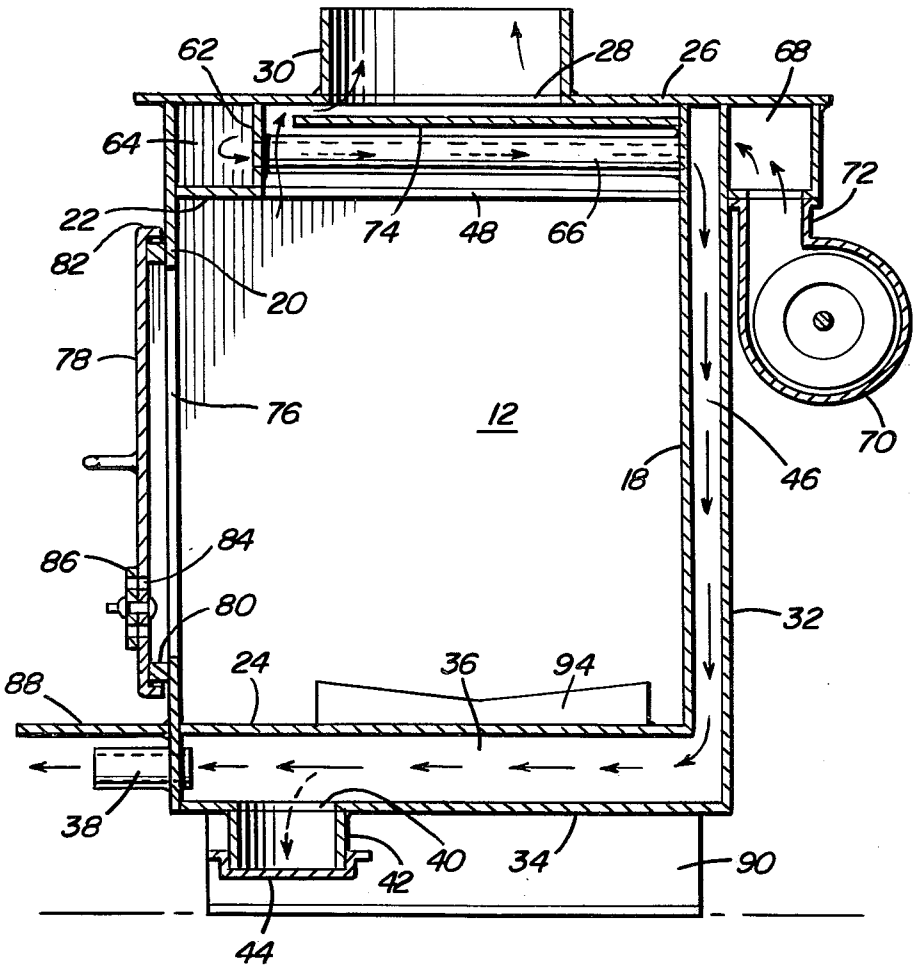
FIG. 4 is a vertical, sectional view taken substantially upon the plane indicated by the section line 4—4 of FIG. 2.
Figure 3:
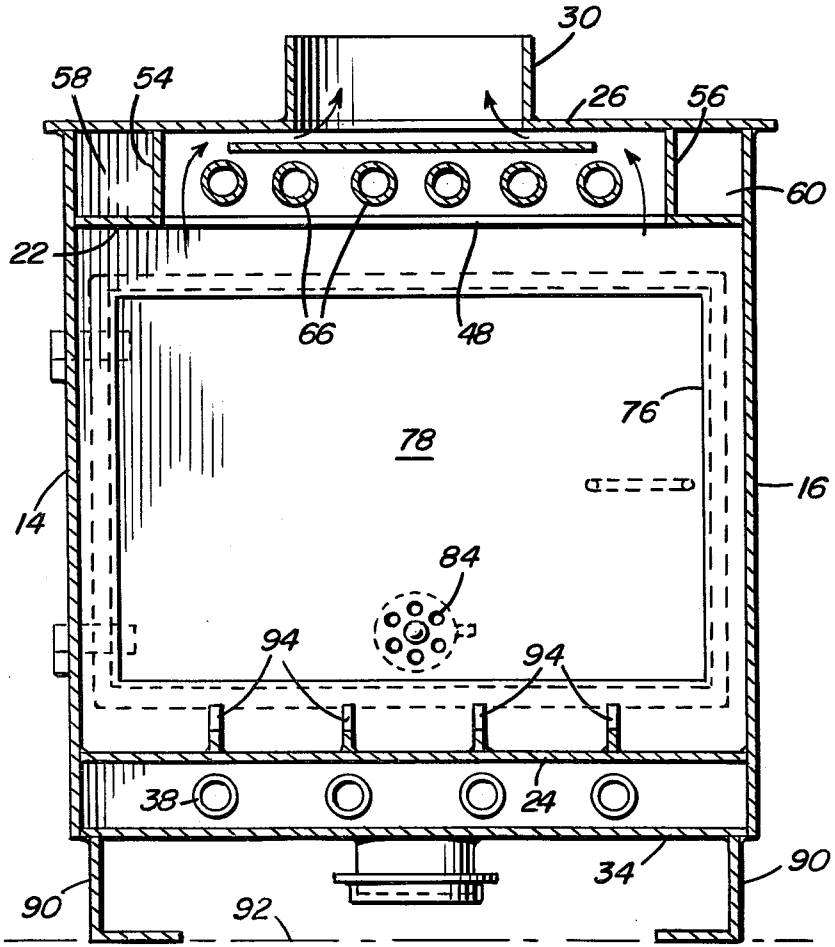
FIG. 3 is an enlarged, fragmentary, vertical, sectional view taken substantially upon the plane indicated by the section line 3—3 of FIG. 1.

Referring now more specifically to the drawings, the numeral 10 generally designates the fireplace furnace of the instant invention. The fireplace furnace 10 includes a firebox 12 defined by upstanding opposite sides 14 and 16 interconnected adjacent their rear marginal portions by means of a rear side 18 extending therebetween. The front marginal edges of the sides 14 and 16 are interconnected by means of a front side 20 extending therebetween and the upper marginal portions of the sides 14, 16, 18 and 20 are interconnected by means of a top side 22 extending therebetween. The lower marginal portions of the side 18 and the lower marginal portions of the sides 14, 16 and 20 are interconnected by means of a bottom side 24 extending therebetween. The upper marginal edges of the sides 14 and 16 as well as the upper marginal edges of the sides 18 and 20 extend upwardly beyond the top side 22 and are interconnected by means of a top wall 26 extending therebetween. The top wall 26 includes a flue outlet opening 28 formed centrally therein and the lower end of an upstanding flue pipe outlet sleeve 30 is secured to the top wall 26 about the opening 28.

The rear marginal edges of the top wall 26 and the sides 14 and 16 extend rearwardly of the rear side 18 and are interconnected by means of a rear wall 32 extending therebetween and projecting below the bottom side 24 and the lower marginal edges of the sides 14, 16 and 20 extend below the bottom side 24 and a bottom wall 34 extends between the lower marginal edges of the sides 12 and 14 as well as the front side 20 and the rear wall 32.

A rear to front extending air passage 36 is defined between the bottom side 24 and the bottom wall 34 and the lower marginal portion of the front side 20 has a plurality of transversely spaced front to rear extending outlet pipes 38 secured therethrough comprising outlets for the front end of the passage 36. In addition, the bottom wall 34 includes an outlet opening 40 formed in the forward marginal portion thereof and a depending outlet pipe 42 is secured to the underside of the bottom wall 34 about the opening 40 and is closed by means of a removable cap 44.

A downwardly extending air passage 46 is defined between the rear side 18 and the rear wall 32 and the top side 22 includes an opening 48 formed therethrough spaced inwardly of the sides 14, 16 and 20. A pair of upstanding front to rear extending partitions 54 and 56 are secured between the top side and top wall on opposite sides of the opening 48 and define upper opposite side rear to front extending side manifolds 58 and 60 between the top side 22 and the top wall 26 and between the partitions 54 and 56 and the sides 14 and 16. A front edge upstanding partition 62 is secured between the top side 22 and the top wall 26 along the forward extremity of the opening 48 and defines an upper front transverse manifold 64 into whose opposite ends the forward ends of the side manifolds 58 and 60 open.

A pair of rear to front extending and transversely spaced tubular heating air flow tubes 66 extend between and open through the partition 62 at their forward ends and the upper marginal portions of the rear side 18 between the top side 22 and the top wall 26 at their rear ends. Accordingly, the tubes 66 communicate the front transverse manifold 64 with the upper portion of the downwardly directed passage 46, the lower end of the latter opening into the rear end of the rear to front extending passage 36.

A hollow transverse manifold 68 is supported from the rear wall 32 and the rear marginal edge of the top wall 26 projecting rearwardly of the rear wall 32 and the opposite end portions of the manifold 68 open into the rear ends of the side manifolds 58 and 60, the opposite side upper marginal portions of the rear side and rear wall 32 terminating at the undersurface of the top side 22.

A blow assembly 70 is supported from the manifold 68 and includes an outlet 72 opening into the manifold 68 centrally intermediate its opposite ends and a horizontal baffle 74 is supported from and extends forwardly of the upper marginal portion of the rear side 18 spaced vertically intermediate the top wall 26 and the tubes 66. The opposite side marginal portions of the baffle 74 are spaced inwardly of the partitions 54 and 56 and the forward marginal edge of the baffle 74 is spaced rearwardly of the partition 62.

The front side 20 includes a fire door opening 76 formed therein and a fire door 78 is hingedly supported from the outer side 16 for horizontal swinging into and out of a closed position closing the fire door opening 76. The outer surface of the front side 20 has a reinforcing bead 80 secured thereto extending about the fire door opening 76 and the fire door 78 includes inturned peripheral flange portions 82 which lap over the outer sides of the reinforcing bead 80. In addition, the fire door 78 has combustion air inlet openings 84 formed therethrough and a rotatable damper 86 is mounted on the exterior of the door 78 for adjustably throttling the passage of combustion air through the openings 84.

The portion of the front side 20 disposed below the fire door 78 includes a horizontally outwardly projecting sill 88 and the opposite side marginal portions of the bottom wall 34 include dependingly supported angle iron legs 90 for support of the fire place furnace 19 in elevated position above a surface 92 upon which the legs 90 rest. Further, the interior of the firebox 12 includes edge upstanding solid fuel cradling front to rear extending and transversely spaced flanges 94 secured thereto as by welding. Accordingly, the flanges 94 not only serve to support solid fuel to be burned within the firebox 12 but also provide reinforcement for the bottom side 24.

If it is desired, the cap 44 may be removed and the outlet pipe 42 may be operatively connected to suitable heating air ducts whereby forced air heated by the fireplace furnace 10 may be ducted to remote areas.

In operation, solid fuels, such as wood, is placed on the flanges 94 and burned within the firebox 12. Ambient heating air is drawn into the blower 70 through the inlet 96 thereof and is forced under pressure through the outlet 72 into the manifold 68. The heating air then passes into the rear ends of the side manifolds 58 and 60 and into the opposite ends of the front manifold 64. Thereafter, the heating air passes rearwardly through the tubes 66 downwardly through the passage 46 and forwardly through the passage 36 before being discharged outwardly of the fireplace furnace 10 through the pipes 34. Also, if the cap 44 is removed and the outlet pipe 42 is communicated with heating air ducts, a portion of the ambient air heated by the fireplace furnace 10 may be ducted to remote locations.

Inasmuch as the coolest air pumped through the manifolds 68, 58 and 60 and through the tubes 66 is in good heat transfer relation with the flue gases before being discharged from the upper portion of the fireplace furnace 10, maximum heat is absorbed from the flue gases. Thereafter, the forced heating air heated by the flue gases passes downwardly through the passage 46 and forwardly through the passage 36 to be even more greatly heated before being discharged through the pipes 38 and/or the outlet pipe 42.

The baffle 74 prevents unobstructed passage of flue gases from the firebox 12 upwardly through the flue outlet opening 28 and enables a greater portion of the heat of the flue gases to be transferred to the tubes 66 and thus to the air passing therethrough.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A heater, said heater defining a firebox including fuel entrance means for allowing introduction of fuel into the firebox, said firebox being defined by front, rear and opposite sides interconnected by a bottom side at their lower ends and by a top side at their upper ends, an outer rear wall extending between the rear marginal portions of said opposite sides rearwardly of said rear side and a bottom wall extending between the lower marginal portions of said opposite sides and between the lower marginal portion of said rear wall and the lower marginal portion of said front side below said bottom side defining a front to rear extending flow passage between said bottom side and bottom wall and downwardly extending flow passage between said rear side and rear wall, the interior of said firebox including hollow upper opposite side rear to front extending side manifolds and an upper front transverse manifold extending between and communicated with the forward ends of said side manifolds, said top side having a flue outlet therein, and a plurality of front to rear extending tubular heating air flow tubes extending between and communicating with said front transverse manifold at their front ends and the upper portion of said downwardly extending flow passage at their rear ends, and means operative to pump air under pressure into the rear ends of said side manifolds, the front to rear extending passage including opening means at its forward end opening through the lower marginal portion of said front side.

2. The heater of claim 1 wherein said front side includes a fire door opening formed therein defining said fuel entrance means, said opening being spaced below said upper front transverse manifold and above said bottom side, and a closure for said fire door opening movable into and out of position closing said fire door opening.

3. The heater of claim 2 wherein said closure includes a fire door horizontally swingably supported from said firebox.

4. The heater of claim 3 wherein said fire door includes variable draft air inlet means for variably throttling the entrance of draft air into said firebox through said fire door.

5. The heater of claim 1 wherein the interior of the upper portion of said firebox includes a horizontal baffle extending forwardly from said rear side, spaced inwardly from said opposite sides, spaced intermediate said top side and air flow tubes and terminating forwardly rearwardly of said upper front transverse manifold.

6. The heater of claim 5 wherein said front side includes a fire door opening formed therein defining said fuel entrance means, said opening being spaced below said upper front transverse manifold and above said bottom side, and a closure for said fire door opening movable into and out of position closing said fire door opening.

7. The heater of claim 1 including an upper rear transverse manifold supported from and extending along the upper marginal portion of said rear wall rearwardly of the latter, said upper rear transverse manifold including air inlet means therefor intermediate its opposite ends, and means communicating the opposite ends of said upper rear transverse manifold with the rear ends of the rear to front extending side manifolds, said means operative to pump air under pressure comprising a blower having an outlet communicated with said air inlet means.

8. The heater of claim 1 wherein said lower marginal portion of said front side includes a plurality of air outlet openings formed therein intermediate the front marginal portions of said bottom side and wall comprising said opening means.

9. The heater of claim 8 wherein said bottom wall includes a depending outlet neck opening upwardly through the forward marginal portion thereof into said front to rear extending flow passage.

10. The heater of claim 1 wherein said bottom side includes front to rear edge upstanding and transversely spaced fuel cradling flanges supported therefrom.

11. The heater of claim 10 wherein said front side includes a fire door opening formed therein defining said fuel entrance means, said opening being spaced below said upper front transverse manifold and above said bottom side, and a closure for said fire door opening movable into and out of position closing said fire door opening.

12. The heater of claim 11 wherein said closure includes a fire door horizontally swingably supported from said firebox.

13. The heater of claim 12 wherein the interior of the upper portion of said firebox includes a horizontal baffle extending forwardly from said rear side, spaced inwardly from said opposite sides, spaced intermediate said top side and air flow tubes and terminating forwardly rearwardly of said upper front transverse manifold.

14. The heater of claim 13 including an upper rear transverse manifold supported from and extending along the upper marginal portion of said rear wall rearwardly of the latter, said upper rear transverse manifold including air inlet means therefor intermediate its opposite ends, and means communicating the opposite ends of said upper rear transverse manifold with the rear ends of the rear to front extending side manifolds, said means operative to pump air under pressure comprising a blower having an outlet communicated with said air inlet means.

* * * * *